US005353699A

United States Patent [19]

Tamura

[11] Patent Number: 5,353,699

[45] Date of Patent: Oct. 11, 1994

[54] HARNESS PRODUCING APPARATUS AND METHOD

[75] Inventor: Yoshikazu Tamura, Ishikawa, Japan

[73] Assignee: Sumitomo Wiring Systems, Ltd., Yokkaichi, Japan

[21] Appl. No.: 151,002

[22] Filed: Nov. 12, 1993

[30] Foreign Application Priority Data

Nov. 13, 1992 [JP] Japan ..... 4-328829

[51] Int. Cl.[5] ..... B41F 17/00

[52] U.S. Cl. ..... 101/35; 101/483; 29/564; 29/861; 29/564.6; 29/593; 226/115; 226/32

[58] Field of Search ..... 101/35-37, 101/93.07, 483, 219, 226, 227, 228; 226/24, 115, 32, 42; 29/854, 861, 868, 564, 564.6, 564.8, 747, 749, 593, 564.3, 564.4

[56] References Cited

U.S. PATENT DOCUMENTS

| | | | |
|---|---|---|---|
| 3,552,308 | 1/1971 | Minehart | 101/36 |
| 3,612,369 | 10/1971 | Grebe et al. | 226/115 |
| 3,713,571 | 1/1973 | Simonton | 226/32 |
| 3,800,389 | 4/1974 | Brehm et al. | 29/564.4 |
| 3,842,496 | 10/1974 | Mercer . | |
| 3,885,161 | 5/1975 | Tarbox et al. . | |
| 4,029,006 | 6/1977 | Mercer | 101/35 |
| 4,187,889 | 2/1980 | Hametner et al. . | |
| 4,580,340 | 4/1986 | Shields | 29/861 |
| 4,584,757 | 4/1986 | Adlon et al. | 29/564.6 |
| 4,603,476 | 8/1986 | Tarbox . | |
| 4,672,871 | 6/1987 | Gudmestad | 29/753 |
| 4,918,804 | 4/1990 | Bleuel et al. | 29/564 |
| 5,247,732 | 9/1993 | Lait et al. . | |

FOREIGN PATENT DOCUMENTS

| | | |
|---|---|---|
| 39-6448319 | 2/1964 | Japan . |
| 60-151906 | 8/1985 | Japan . |
| 1369798 | 10/1974 | United Kingdom . |

*Primary Examiner*—Eugene H. Eickholt
*Attorney, Agent, or Firm*—Sughrue, Mion, Zinn, Macpeak & Seas

[57] ABSTRACT

The invention aims to correctly apply a distinctive mark at a given position of a harness and simplify a construction of a harness producing apparatus. A cable path length adjusting mechanism 100 sets a cable path length from a cutting position of a cutter 141 to a center position of marking tools 220 to be the same as a length of an electrical cable 50 to be cut. A cable feeding mechanism 110 locates the cable 50 with respect to the cutter 141 and marking head 221*a* and 221*b* only by a feed of the cable. It is possible to correctly apply the distinctive mark on a given area of the harness without changing a relative distance between the cutting position of the cable 50 and the applying position of the distinctive mark. Further, a marking mechanism 200 is disposed on an upper stream with respect to the cable feeding mechanism 110 and is not disposed in the cable end treating unit in which devices are complicatedly arranged, thereby simplifying the construction of the apparatus.

2 Claims, 12 Drawing Sheets

HARNESS PRODUCING APPARATUS AND METHOD

BACKGROUND OF THE INVENTION

1. Field of the Invention

This invention relates to an apparatus and a method of producing a harness in which a distinctive mark is applied to an outer periphery of an electrical cable.

2. Statement of the Prior Art

There are many kinds of harness to be mounted on an automobile or the like. A distinctive mark is applied on an outer periphery of each electrical cable in order to easily distinguish a cable kind in each harness.

A prior apparatus for producing a harness on which the distinctive mark is applied will be described below by referring to FIGS. 13 to 18 for convenience of explanation.

FIG. 13 is a plan view of a prior harness producing apparatus. FIG. 14 is a side view of the prior harness producing apparatus. FIG. 15 is a side view of the prior harness producing apparatus illustrating another state. FIG. 16 is a side view of the prior harness producing apparatus illustrating still another state.

A harness producing apparatus A1 disclosed in Japanese Patent Public Disclosure No. 80-151906 is illustrated in FIGS. 13 to 16.

The harness producing apparatus A1 comprises a cable feeding mechanism 20 having two feeding rollers 11, a pair of draw rollers 12*a*, a front side clamp 12, a cutter mechanism 13 having a plurality of cutters 13*a* and 13*b*, a rear side clamp 14, two terminal press-attaching mechanisms 21*a* and 21*b* disposed on the opposite sides of the cutter mechanism 13, and two marking mechanisms 22*a* and 22*b* disposed adjacent to the press-attaching mechanisms 21*a* and 21*b*. An electrical cable 10 is passed along a predetermined cable pass line in the apparatus A1.

Both clamps 12 and 14 hold the cable 10 and the cutters 13*a*, 13*b* of the cutter mechanism 13 operates in synchronization with the clamps 12 and 14. Then, a middle cutter 13*a* in the cutter mechanism 13 cuts off the cable 10 and opposite side cutters 13*b* cut into sheaths of the cables. While maintaining this state, the front side clamp 12 moves in a direction shown by an arrow Q so that the cable 10 held by the clamp 12 (hereinafter referred to as "residual cable" 10) moves in the direction Q, thereby stripping the sheath from an end of the residual cable 10. At the same time, the rear side clamp 14 moves in a direction shown by an arrow P so that the cable 10 held by the clamp 14 (hereinafter referred to as "cut cable" 10) is stripped of its sheath at one end.

Then, The residual cable 10 together with the front side clamp 12 move in a direction shown by an arrow R in FIG. 13, a terminal 2 (FIG. 1B) is press-attached to a stripped end of the residual cable 10 by a terminal press-attaching mechanism 21*a*, a distinctive mark is applied to the residual cable 10 near the stripped end thereof by the marking mechanism 22*a*, and the front side clamp 12 returns to its original position.

On the other hand, the cut cable 10 together with the rear side clamp 14 move in a direction shown by an arrow S in FIG. 1, a terminal (not shown) is press-attached to a stripped end of the cut cable 10 by a terminal press-attaching mechanism 21*b*, the distinctive mark is applied to the cut cable 10 near the stripped end thereof by the marking mechanism 22*b*, the cut cable 10 is discharged to a given discharging position, and the clamp 14 returns to the original position.

Then, after both clamps 12 and 14 release the cable, two feeding rollers 11 are rotated and the electrical cable 10 is fed toward the draw rollers 12*a*. At a little time lag after feeding the cable, the draw rollers rotate so that the sheathed cable 10 is fed to the rear side clamp 14.

Thereafter, the above steps are repeated to produce the cut cable (harness) which is provided with the terminals 2 on the opposite stripped ends thereof and the distinctive mark on the given area.

However, since the indicative mark is applied to the cable simultaneously with a terminal press-attaching process, namely a cable end treating process after cutting the cable in the harness producing apparatus A1, it is necessary to further dispose the marking mechanisms 22*a* and 22*b* on a cable end treating section on which the front side clamp 12, cutter mechanism 13, rear side clamp 14, terminal press-attaching mechanisms 21*a* and 21*b* and the like have a complicated arrangement, thus making the construction intricate.

In order to eliminate the above problem, Japanese Patent Public Disclosure No. 64-48319 (1989) discloses an apparatus which applies an indicative mark to an electrical cable prior to cutting it.

In another prior harness producing apparatus A2 shown in FIG. 16, the marking mechanism 30 is disposed on an upstream from the cable feeding mechanism 20 in a cable Feeding direction P. The marking mechanism 30 is provided with a pair of feeding rollers 31 adapted to clamp the cable 10 and a pair of marking heads 32 adapted to contact with the outer periphery of the cable 10. Further, a cable storage mechanism 40 is arranged between the cable feeding mechanism 20 and the marking mechanism 30 in order to receive the cable 10 therebetween.

In the harness producing apparatus A2, the cable 10 is intermittently fed in the direction P by clamping and driving the cable 10 by the feeding rollers 31 in the marking mechanism 30. The marking heads 32 press the cable during a feed resting period so that the distinctive mark 5 is applied to the cable 10 at a given outer face thereof.

On the other hand, the feeding rollers 11 of the cable feeding mechanism 20 feed the cable 10 intermittently in the same manner, the cutter mechanism 13 cut the cable 10, and the cable end treating processes such as end sheath stripping, terminal press-attaching and the like are carried out.

Since the distinctive mark is applied to the cable prior to cutting it in the harness producing apparatus A2, it is not necessary to dispose the marking mechanism 30 in the cable end treating section near the cutter mechanism 13 in which many elements are arranged complicatedly. Accordingly, the apparatus A2 does not bring about a problem of complication in construction.

However, since the feeding rollers 31 of the marking mechanism 30 feed the cable intermittently in the apparatus A2 while the feeding rollers 11 of the cable feeding mechanism 20 feed the cable intermittently independent upon the feeding rollers 31, a gap between a cutting position of the cable 10 and a marking position of the cable is caused due to feed errors between both rollers 11 and 31 upon operation of the apparatus for a long time. Consequently, it is impossible to precisely apply the distinctive mark to a given area on the harness 1.

SUMMARY OF THE INVENTION

A first object of the present invention is to provide a harness producing apparatus which has a simple construction and can apply a distinctive mark to a given area on a harness.

A second object of the present invention is to provide a harness producing method which can apply a distinctive mark to a given area on a harness.

In order to achieve the first object, the harness producing apparatus of the present invention comprises:

a cable feeding mechanism for intermittently feeding an electrical cable by a given length along its longitudinal direction; a marking mechanism disposed on an upper stream along a cable feeding direction of said cable feeding mechanism for applying a distinctive mark on said electrical cable during a feed resting period of said cable feeding mechanism; a cable end-treating unit disposed on a lower stream along said cable feeding direction of said cable feeding mechanism for cutting said cable fed by the given length to form a cut electrical cable having a given length during said feed resting period of said cable feeding mechanism; and a cable path length adjusting mechanism for adjusting a cable path length between said marking mechanism and said cable end treating mechanism in accordance with the length of said cut cable.

In order to achieve the second object, the harness producing method by using a harness producing apparatus of the present invention includes: a cable feeding mechanism for feeding an electrical cable in its longitudinal direction; a marking mechanism disposed on an upper stream along a cable feeding direction of said cable feeding mechanism for applying a distinctive mark on said electrical cable; a cable end treating unit disposed on a lower stream along said cable feeding direction of said cable feeding mechanism for cutting said cable fed; and a cable path length adjusting mechanism disposed between said marking mechanism and said cable end treating mechanism for adjustably setting a cable path length therebetween. The method of the present invention comprises the steps of: setting said cable path length between said marking mechanism and said cable end treating unit to be a given length in accordance with the length of the cut cable by said cable path length adjusting mechanism; feeding said electrical cable intermittently by a given length by said cable feeding mechanism; applying a mark on said electrical cable during a feed resting period by said marking mechanism; and cutting said electrical cable fed by a given length from said cable feeding mechanism to form a cut electrical cable having a given length by said cable end treating unit during said feed resting period.

According to the present invention, since the cable path length adjusting mechanism for adjusting the cable path length is provided between the marking mechanism and the cable end treating mechanism, it is possible to position the electrical cable with respect to the cable end treating unit and marking mechanism only by feeding operation due to the cable feeding mechanism and by setting the cable path length to be a given length in accordance with the cut cable by means of the cable path length adjusting mechanism. At this time, a relative distance between the cable cutting position and the distinctive mark applying position is not changed. It is possible to apply the distinctive mark at the proper position on the cable and thus possible to precisely apply the distinctive mark on a given area on the harness. In addition, the marking mechanism is disposed rather than near the cable end treating unit in which many devices are arranged, on an upper stream from the marking mechanism. Consequently, the marking mechanism does not bring a complication of construction into the apparatus.

DETAILED DESCRIPTION OF THE PREFERRED EMBODIMENTS

Referring now to FIGS. 1 to 4, a first embodiment of a harness producing apparatus H1 of the present invention will be explained below.

Figure 7:
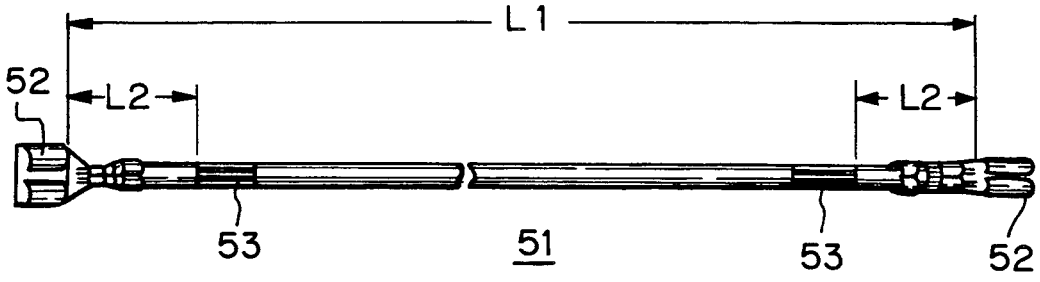
FIG. 7 is a plan view of a harness produced by the first embodiment of the harness producing apparatus.

As shown in the drawings, the harness producing apparatus comprises along an electrical cable pass line X a straightener 90, a marking mechanism 200, a cable path length adjusting mechanism 100, a cable feeding mechanism 110, a cable guide mechanism 120, a pair of draw rollers 131, a front side clamp 130, a cutter mechanism 140 and a rear side clamp 150, and terminal press-attaching mechanisms 160 and 170 arranged on opposite sides of the cutter mechanism 140. An electrical cable 50 fed intermittently by the cable feeding mechanism 110 is passed in sequence through the straightener 90, marking mechanism 200, cable path length adjusting mechanism 100, cable feeding mechanism 110, cable guide mechanism 120, draw rollers 131 and front side clamp 130 so as to carry out a plurality of treatments described after. Consequently, a harness 51 having a distinctive mark 53 on a given area on the outer face and terminals 52 on the opposite ends shown in FIG. 7 is produced successively.

The cable feeding mechanism 110 has two rotatable Feeding rollers 111. When the feeding rollers 111 are rotated by a driving means not shown with the electrical cable 50 being wound about two feeding rollers 111 in an S like path, the cable 50 is fed by a distance corresponding to an amount of rotation of the rollers 111 in a longitudinal direction (cable pass line X) in the direction shown by an arrow P (hereinafter referred to as "cable feeding direction P").

The straightener 90 has a plurality of rollers 91 disposed on the opposite sides along the cable pass line X. The cable 50 pulled from a stock reel not shown is corrected its residual curl nature when it passes through the rollers 91.

Figure 1:
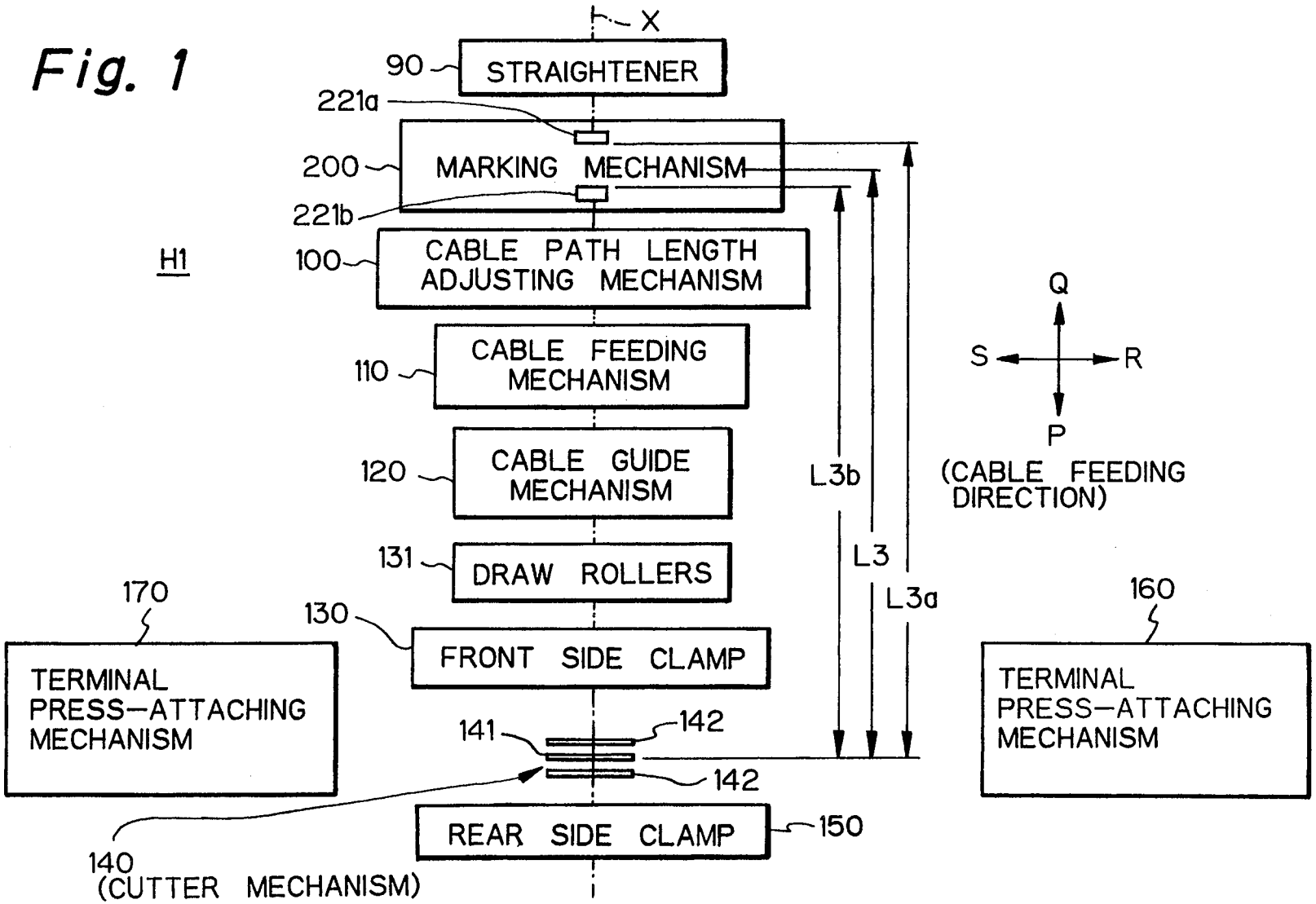
FIG. 1 is a plan view of a first embodiment of a harness producing apparatus of the present invention.
Figure 2:
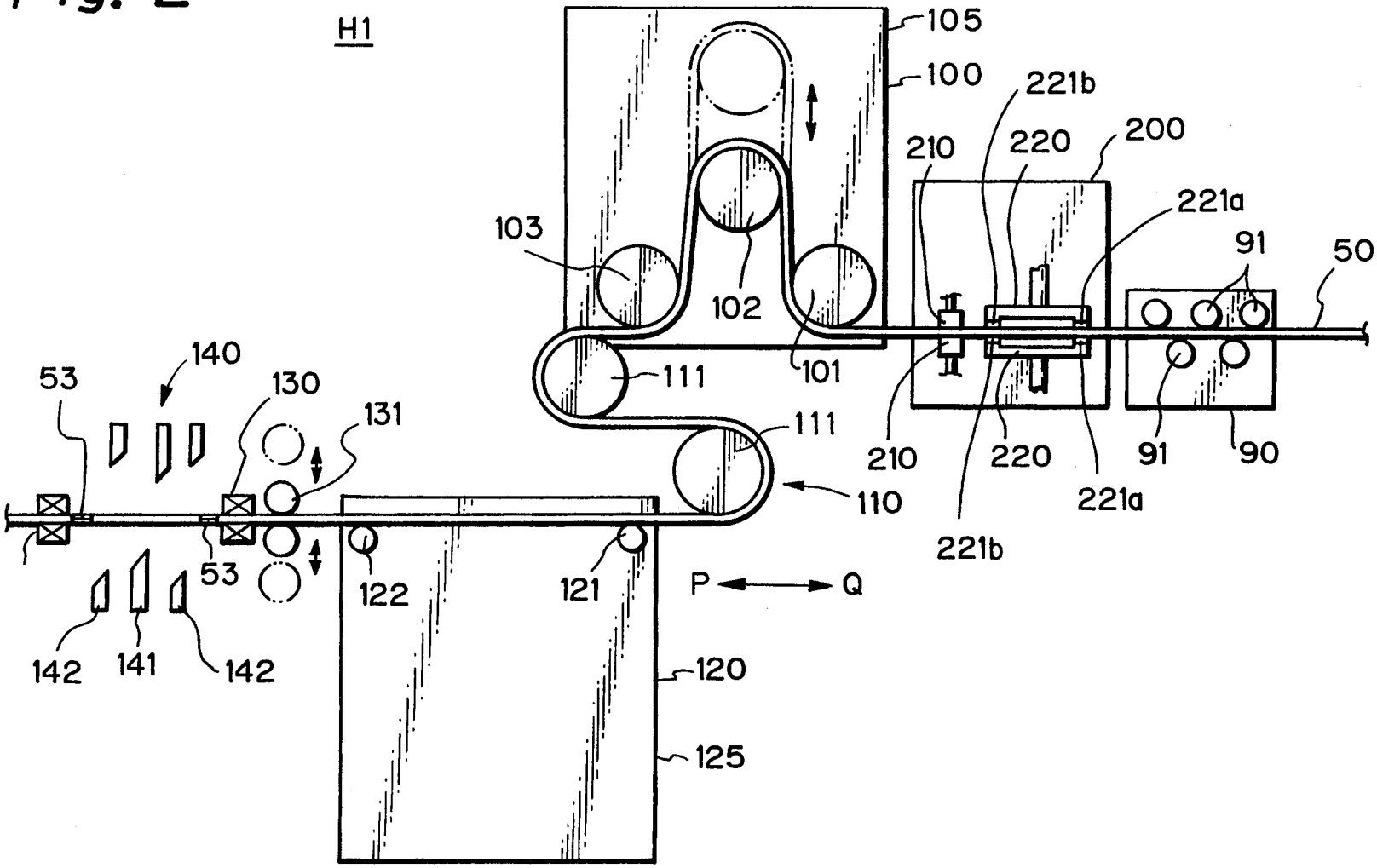
FIG. 2 is a side view of the first embodiment of the harness producing apparatus.
Figure 3:
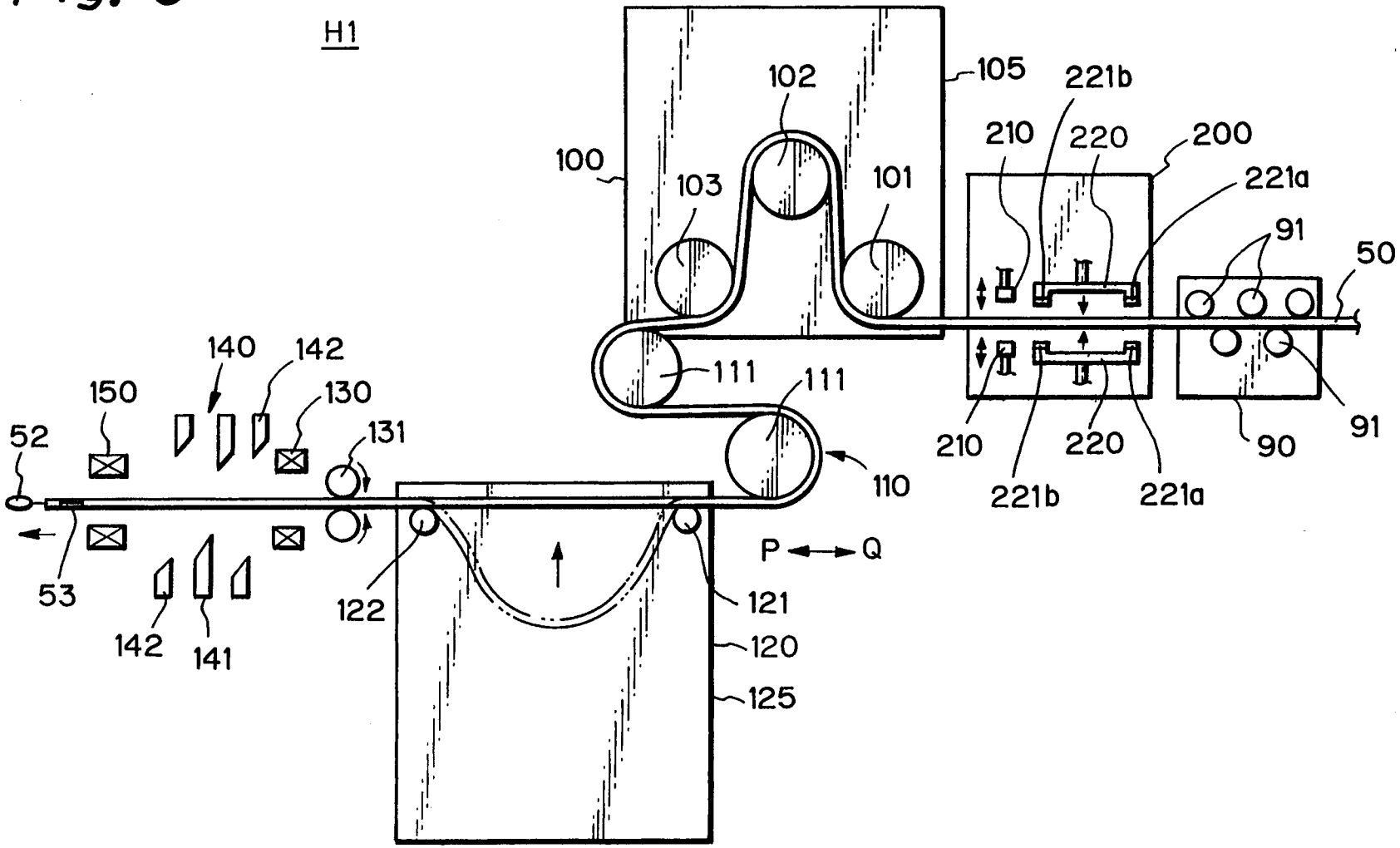
FIG. 3 is a side view of the first embodiment of the harness producing apparatus illustrating another state.
Figure 4:
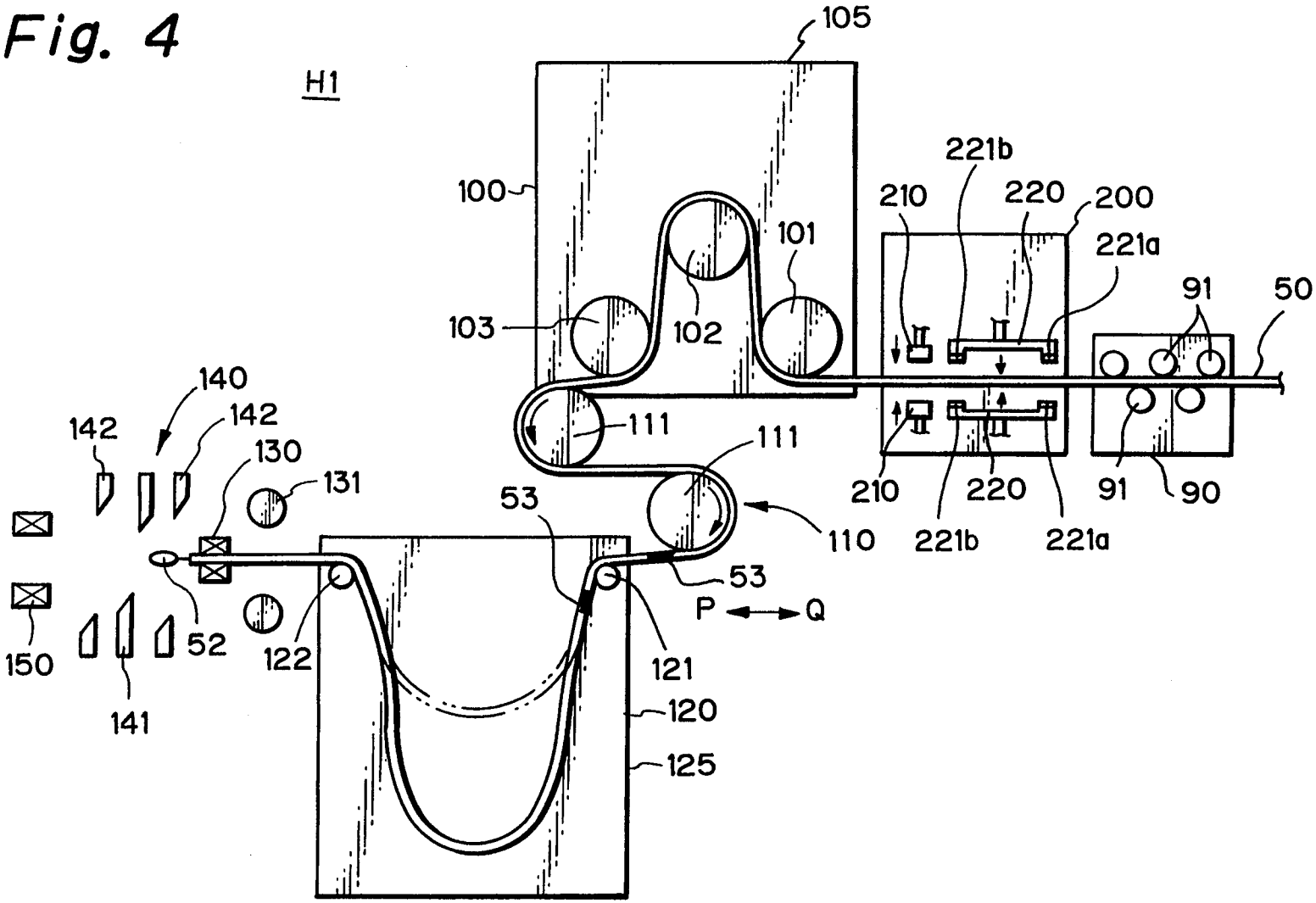
FIG. 4 is a side view of the first embodiment of the harness producing apparatus illustrating still another state.
Figure 5:
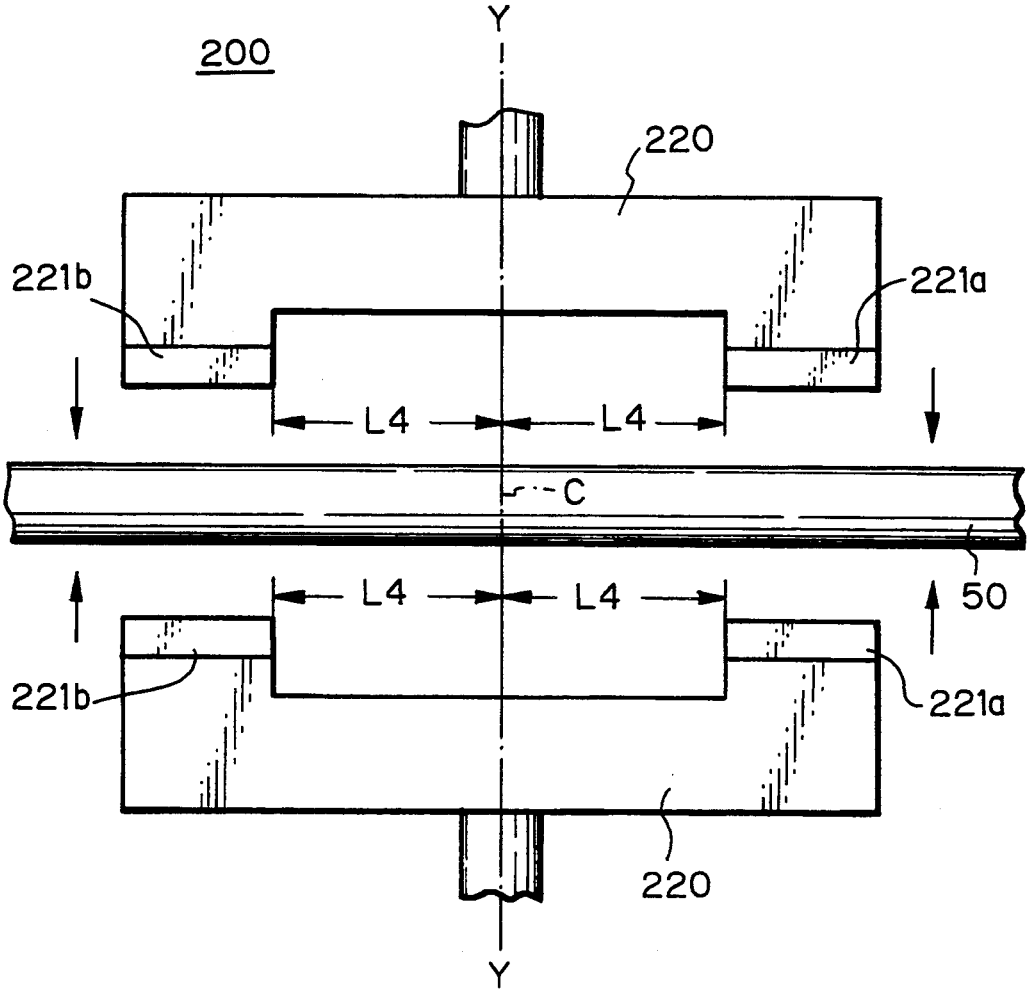
FIG. 5 is a side view of a main part of a marking mechanism to be applied to the first embodiment.
Figure 6:
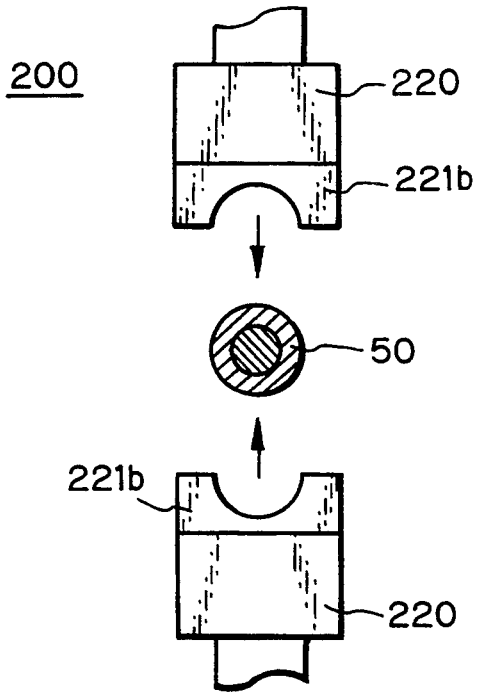
FIG. 6 is a front side view of a main part of the marking mechanism to be applied to the first embodiment.

FIG. 5 is a side elevational view of a main part of the marking mechanism 200 and FIG. 6 is a front elevational view of the main part. As shown in FIGS. 1 to 6, the marking mechanism 200 includes a clamp 210 which clamps and releases the cable 50 on the cable pass line X by driving means such as an air cylinder or the like and a pair of marking tools 220 disposed upper and lower sides along the cable pass line X.

Marking heads 221*a* and 221*b* made of a felt material are disposed on opposite sides of the marking tools 220. The marking heads 221*a* and 221*b* are formed to be concave on their opposite faces so that the concaves accord a half outer peripheral face of the cable 50. Also, in the marking tools 220, distances L4, L4 from a center position Y (FIG. 5) to each end of the marking heads 221*a* and 221*b* are the same as each other. The distances L4. L4 are equal to distances L2. L2 (FIG. 7) from an end of the cable of a harness described after to an end of a distinctive mark applying area. Further, the marking mechanism 200 is provided with a coloring agent supply means not shown, which supplies a coloring agent for marking the marking heads 221*a* and 221*b* at any time.

A driving means such as an &it cylinder or the like not shown moves tile pair of marking tools toward or away from each other so that the marking heads 221*a* and 221*b* clamp and release the cable 50 on tile cable pass line X. When the marking heads 221*a* and 221*b* contact with the outer peripheral face of the cable 50, the coloring agent is supplied on the outer peripheral face to present the distinctive mark 53 to the face.

The cable path length adjusting mechanism 100 has three rollers 101, 102, and 103 which are rotatably mounted on a body 105. The center roller 102 out of the three rollers 101, 102, and 103 is supported so that it can move up and down and be fixed at any position by a securing means not shown.

The electrical cable 50 is passed beneath the opposite rollers 101 and 103 and above the center roller 102. It is possible to adjust the cable path length in the cable path length adjusting mechanism 100, namely between the marking mechanism 200 and the cable feeding mechanism 110 by displacing the fixed position of the center roller 102 up or down.

Two spaced guide rollers 121 and 122 are rotatably attached to an upper end of a body 125 of the cable guide mechanism 120. While the cable 50 fed from the feeding rollers 111 is loosened between the guide rollers 121 and 122, the cable 50 waits for driving until it is fed by draw rollers 131 described below.

A pair of draw rollers 131 can move toward and away from each other and serve to clamp the cable 50 on the cable pass line X so that the cable 50 is fed along the cable feeding direction P when the draw rollers 131 rotate.

The front side clamp 130 serves to clamp and release the cable 50 on the cable pass line X and can be moved in a horizontal plane including the cable pass line X by the driving means not shown.

The cutter mechanism 140 includes a pair of cutters 141 which cut off the cable 50 on the cable pass line X and two pairs of cutters 142 which are disposed on the opposite sides of the cutters 141 and cut into a sheath of the cable 50. Further, each pair of cutters 141 and 142 in the cutter mechanism 140 open and close in synchronization with each other.

The rear side clamp 150 serves to clamp and release the cable 50 on the cable pass line X and can be moved in a horizontal plane including the cable pass line X by the driving means not shown.

The cable end treating section is constituted of the front side clamp 130, cutter mechanism 140, rear side clamp 150, and terminal press-attaching mechanisms 160 and 170.

On the other hand, in a harness producing apparatus H1, each of the driving means is connected to a control device not shown. Each driving means is controlled in accordance with an output signal from the control device to carry out an operation described below.

The operation of the harness producing apparatus H1 is described below.

In the case of setting the electrical cable 50 in the apparatus prior to starting the operation, the cable 50 pulled from a stock reel not shown is passed through a plurality of rollers 91 of the straightener 90 and then passed through the pair of marking tools 220 and the clamp 210. Further, the cable 50 moves on the lower side of the roller 101 and on the upper side of the roller 102 and on the lower side of the roller 103 and then is wound around the two feeding rollers 111 of the cable feeding mechanism 110 in an S like path. Further, after passing the cable 50 on two guide rollers 121 and 122 of the cable guide mechanism 120, the cable is passed through the pair of draw rollers 131, the front side clamp 130, the cutters 141 and 142 of the cutter mechanism 140 and the rear side clamp 150.

At this time, the clamp 210 of the marking mechanism 200 and the clamps 130 and 150 of the cable end treating section release the cable 50 respectively and the marking tools 220 are opened. Also, the pair of the draw rollers 131 are opened to release the cable 50.

Figure 8:
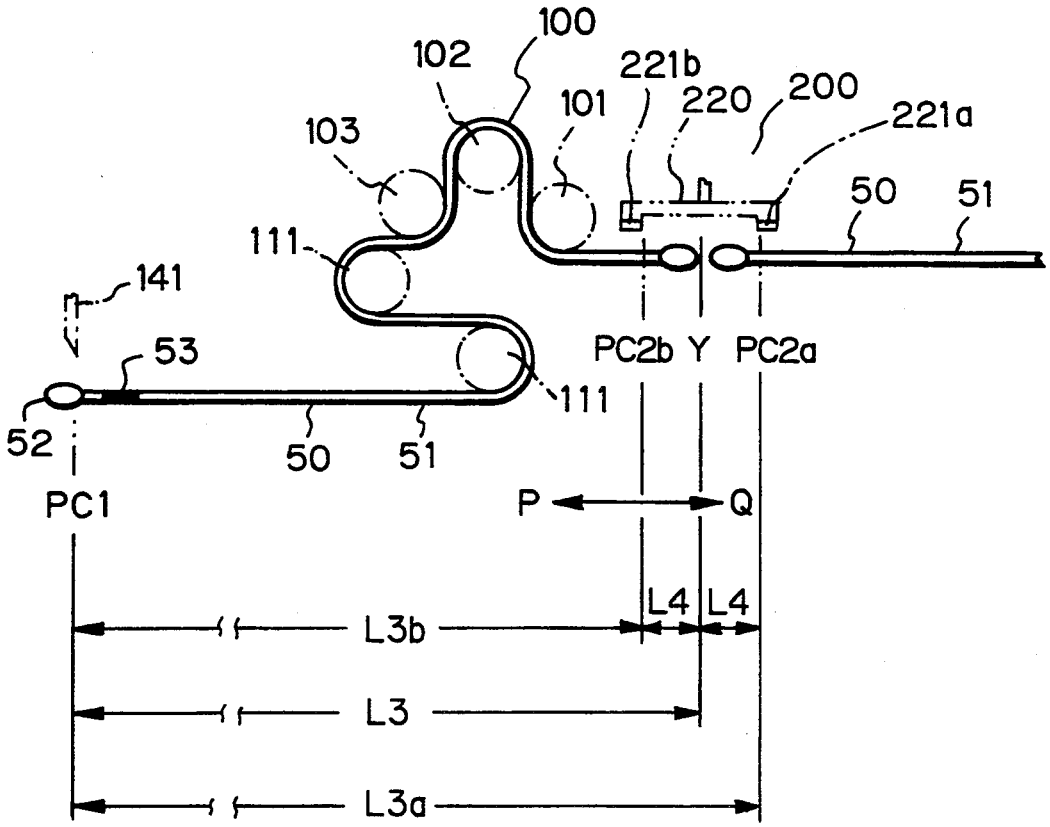
FIG. 8 is an explanatory view of setting a path length of an electrical cable in the first embodiment.

The fixed position of the roller 102 of the cable path length adjusting mechanism 100 is set to be L3=L1, when L1 is a length (cutting length) of an electrical cable of the harness 51 to be produced and L3 is a distance (cable path length) from a cutting position PC1 of the harness to the center position Y of the marking tools 220 along the cable pass line X, as shown in FIGS. 7 and 8.

When L2 is a distance (hereinafter referred to as "distinctive mark area distance") from a cable end of the harness 51 to an area end of the distinctive mark 53 and L3*a* and L3*b* (FIG. 1) is a distance (cable pass distance) from ends PC2*a* and PC2*b* of the distinctive mark area (hereinafter referred to as "distinctive mark area") worked by the marking heads 221*a* and 221*b* to the cutting position PC1 worked by the cutter 141 along the table pass line X, since the size relation L4=L2 is satisfied, the above equation L3=L1 may be expressed by equations L3*a*=L1+L2 and L3*b*=L1−L2.

When a command for starting the operation is given to the above apparatus in this state, after the cable 50 is held by the front and rear side clamps 130 and 150, and the clamp 210 of the marking mechanism 200, the cutters 141 and 142 are closed in synchronization with each other so that the cutter 141 cuts off the cable and the cutters 142 cut into the sheath on the cable on the opposite sides of the cutting position. Further, the front side clamp 130 moves in a direction Q opposite to the cable feeding direction P, so that a sheath of the cable 50 held by the clamp 130 (hereinafter referred to as "residual cable 50") is stripped from the cable in a lower stream in the cable feeding direction P. In parallel with this process, the rear side clamp 150 moves in the cable feeding direction P, so that a sheath of the cable 50 held by the clamp 150 (hereinafter referred to as "cut cable" 50) is stripped from the cable in an upper stream in the cable feeding direction P (cutting and stripping process).

On the other hand, in synchronization with these cutting and stripping processes, the marking tools 220 of the marking mechanism 200 are closed so that the marking heads 221*a* and 221*b* clamp the cable 50 and then the heads apply the coloring agent on the outer face of the cable 50 to present the distinctive mark 53 thereon.

The front side clamp 130 holding the residual cable 50 moves toward the terminal press-attaching mechanism 160 in the direction shown by the arrow R and the terminal 52 is press-attached on the stripped end of the residual cable 50 by the terminal-press-attaching mechanism 160. Then, tile front side clamp 130 moves in the direction S, so that the residual cable 50 is put on the cable pass line. In parallel with this process, the rear side clamp 150 moves toward the terminal press-attaching mechanism 170 in the direction S, so that a terminal 52 is press-attached to the stripped end of the cut cable 50. Then, the rear side clamp 150 releases the cut cable 50 to discharge it at a given position and returns to the cable pass line X.

While the terminal press-attaching process is being curried out, the clamp 210 of the marking mechanism 200 releases the cable 50, the feeding roller 111 of the cable feeding mechanism 110 is driven to feed the cable 50 by a distance corresponding to the cutting length L1 along the cable feeding direction P and the cable 50 is loosed between the guide rollers 121 and 122 of the cable guide mechanism 120 by a loop length corresponding to the cutting length L1.

The front side clamp 130 releases the cable 50 while the draw roller 131 clamps and drives the residual cable 50. Consequently, the cable 50 is fed toward the rear side clamp 150 until the loosed loop of the cable between the guide rollers 121 and 122 is eliminated. Thus, the marking heads 221*a* and 221*b* of the marking mechanism can be positioned in opposition to a next distinctive mark area on the cable to be worked by feeding the cable 50 by the cutting length L1 by the feeding rollers 111.

Hereafter, the above operation is repeated, thereby producing the harness 51 having the distinctive mark 53 on the given area on the outer face and terminals 52 on the opposite ends.

According to the harness producing apparatus H1, since the cable path length adjusting mechanism 100 which can set any cable path length is disposed between the cable feeding mechanism 110 and the marking mechanism 200 and the cable path length L3 from the cutting position PC1 for the harness 51 to the center position Y of the marking tools is set to be equal to the length L1 of the cut cable 51, the distances L3*a* and L3*b* arranging the cable 50 from the marking areas PC2*a* and PC2*b* of the marking heads 221*a* and 221*b* to the cutting position PC1 of the cutter 141 are equal to a sum (L1+L2) and a difference (L1−L2) of the cutting length L1 of the cable 50 and the distance L2 of tile marking area and also it is possible to position the cable 50 with respect to the cutter 141 and marking heads 221*a* and 221*b* by only a single mechanism, namely the cable feeding mechanism 110. Accordingly, such feeding by only the cable feeding mechanism 110 does not change a relative position between the cable cutting position and the marking position and can properly apply the distinctive mark 53 to the marking area on the harness 51 with respect to the cable cutting position, even if a feeding amount is changed due to feeding errors in the cable feeding mechanism 110 in a long time lapse.

Also, the marking mechanism 200 does not cause any problem of complication in the construction of the apparatus, since the marking mechanism 200 is not disposed in the cable end treating section around the cutter mechanism 140 in which so many elements are intricately arranged but disposed upstream from the cable feeding mechanism 110.

Figure 9:
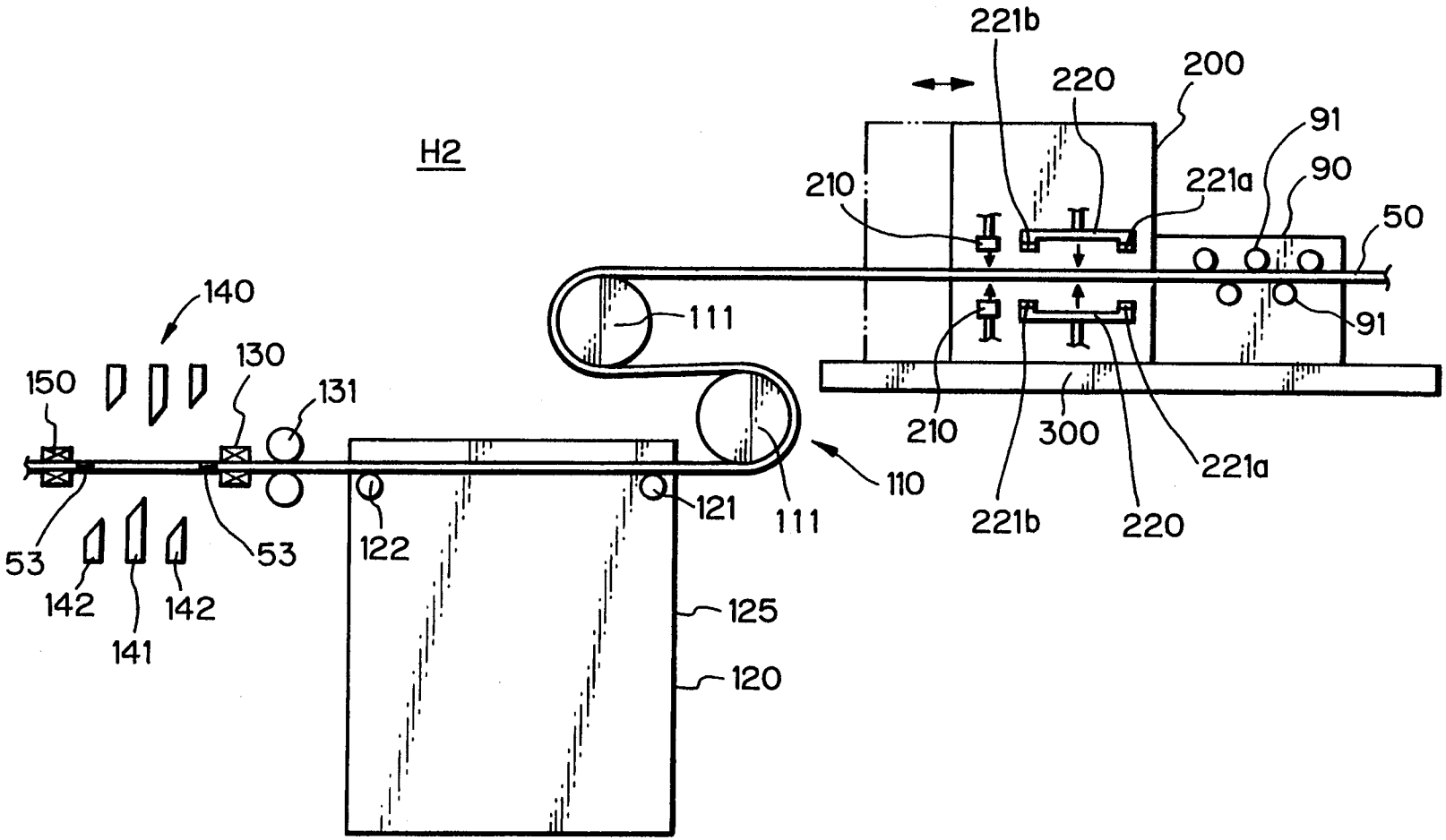
FIG. 9 is a side view of a second embodiment of the harness producing apparatus of the present invention.

FIG. 9 is a schematic side elevational view of a second embodiment of a harness producing apparatus H2 of the present invention. As shown in the drawing, the harness producing apparatus comprises along an electrical cable pass line X a straightener 90, a marking mechanism 200, a cable feeding mechanism 110, a cable guide mechanism 120, a pair of draw rollers 131, a front side clamp 130, a cutter mechanism 140 and a rear side clamp 150, which are arranged along the cable pass line in the same manner as the first embodiment of the harness producing apparatus H1.

The straightener 90 and marking mechanism 200 are supported on a cable path length adjusting mechanism 300 so that they can be moved together with mechanism 300 along the cable pass line and fixed at any position by a securing means not shown.

The other constructions of the second embodiment H2 are the same as those of the first embodiment H1.

In the harness producing apparatus H2, the straightener 90 and marking mechanism 200 are moved relative to the cable feeding mechanism 110 by the cable path length adjusting mechanism 300, and a cable path length (L3) from the center position of the marking tools 220 to the cutting position of the cutter 141 is set to be equal to a cutting length (L1) of the cable 50, thereby producing the harness 51.

In the harness producing apparatus H2, since the positioning of the cable 50 with respect to the cutting position for the cutter 141 and the marking position for the marking heads 221*a* and 221*b* can be carried out by only the cable feeding mechanism 110, the relative position between the cutting position and the marking position can not be changed, thereby properly applying the distinctive mark 53 to the given marking area on the harness 51.

It is also possible to apply the distinctive mark 53 to any marking area on the harness 51 by suitably altering a length (L4) of the marking tools 220 along the cable feeding direction P.

Figure 10:
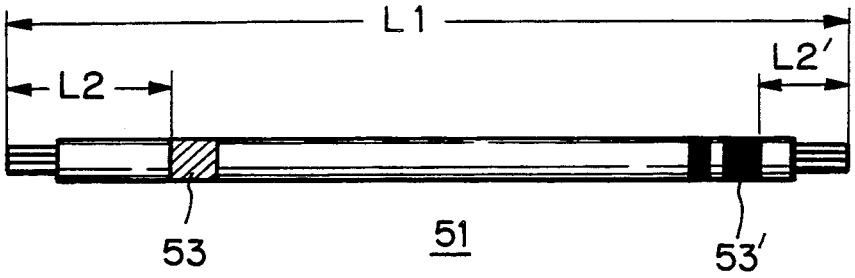
FIG. 10 is a plan view of a harness to which indicative marks are applied.

Although the kind of the distinctive mark 53 and the distance L2 from the end of the harness 51 or the marking position are of the same at the opposite ends of the harness 51 in the above embodiments as shown in FIG. 7, the kinds of the distinctive marks 53 and 53' and the distances L2 and L2' from the end of the harness 51 to the marks 53 and 53' may be different from each other at the opposite ends thereof, as shown in FIG. 10. In this case, the right and left marking heads 221*a* and 221*b* may be formed in accordance with the right and left distinctive marks 53' and 53 and the respective distances L3, L3*a* and L3*b* shown in FIG. 8 may be set to be L3=L1, L3*a*=L1+L2, and L3*b*=L1−L2'.

Figure 11:
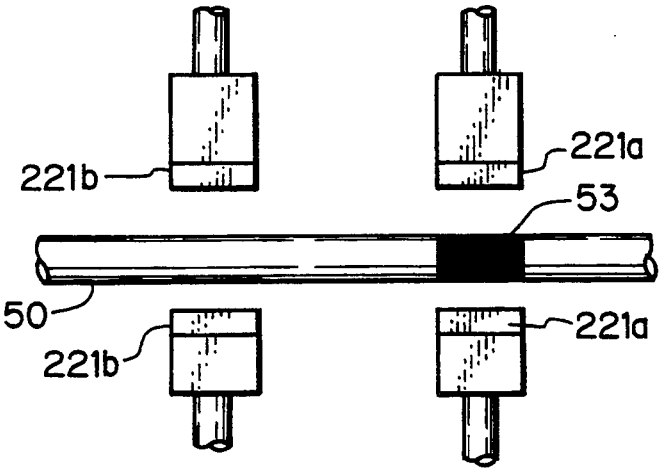
FIG. 11 is a front side view of another marking mechanism.
Figure 12:
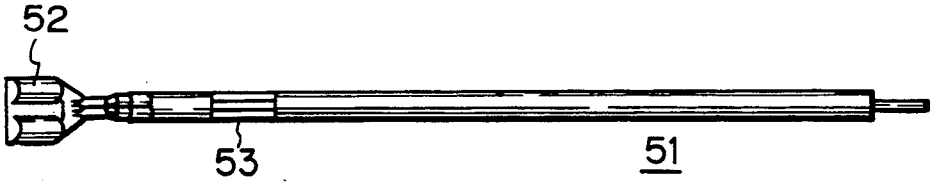
FIG. 12 is a plan view of a harness in another form.
Figure 13:
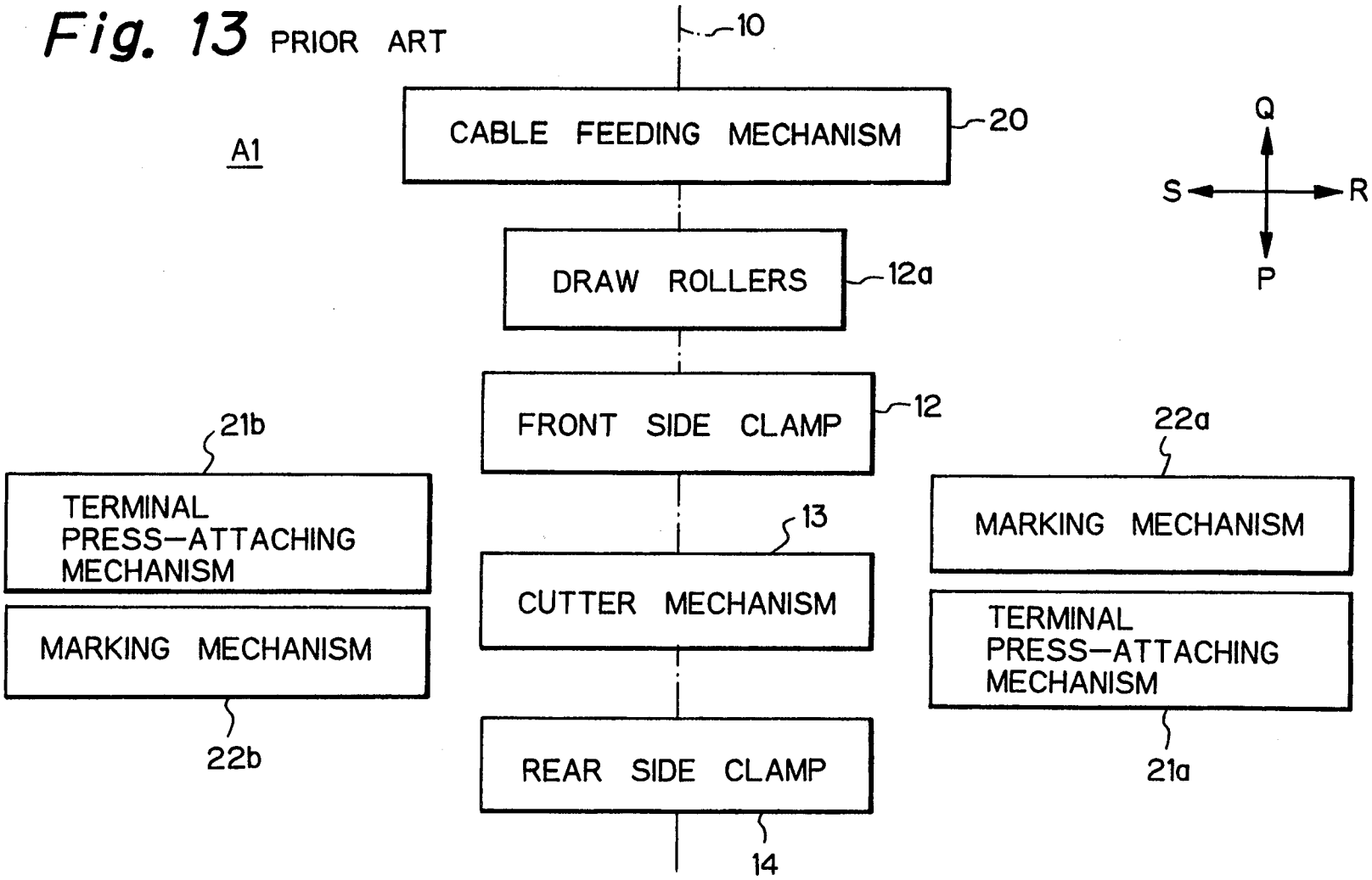
Fig. 13 PRIOR ART
FIG. 13 is a plan view of a prior harness producing apparatus.
Figure 14:
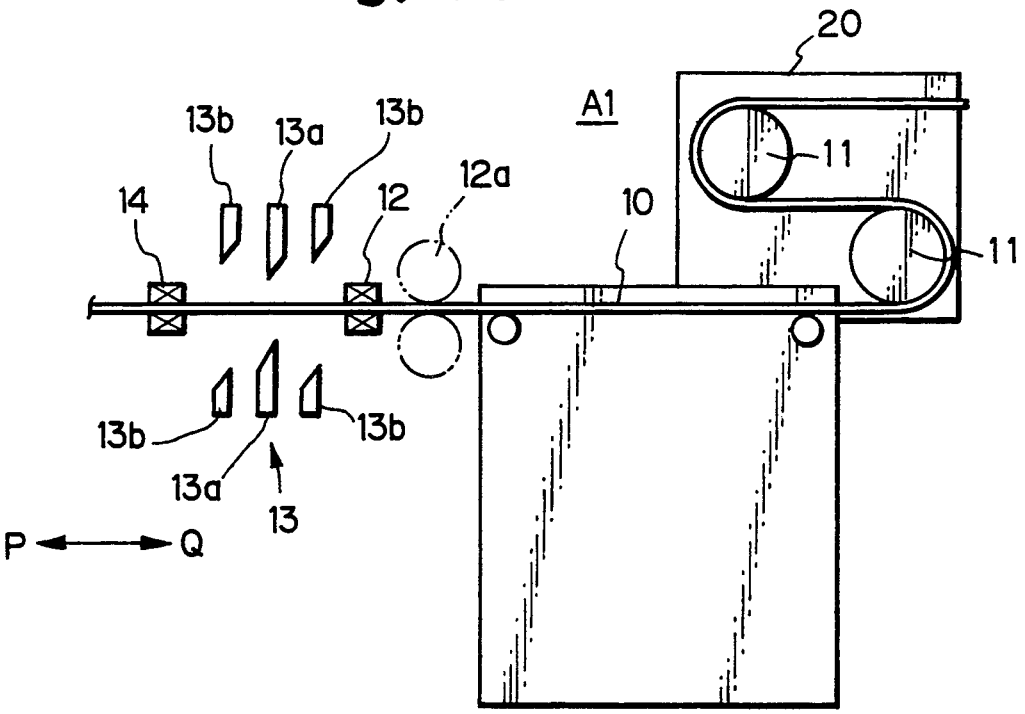
Fig. 14 PRIOR ART
FIG. 14 is a side view of the prior harness producing apparatus.
Figure 15:
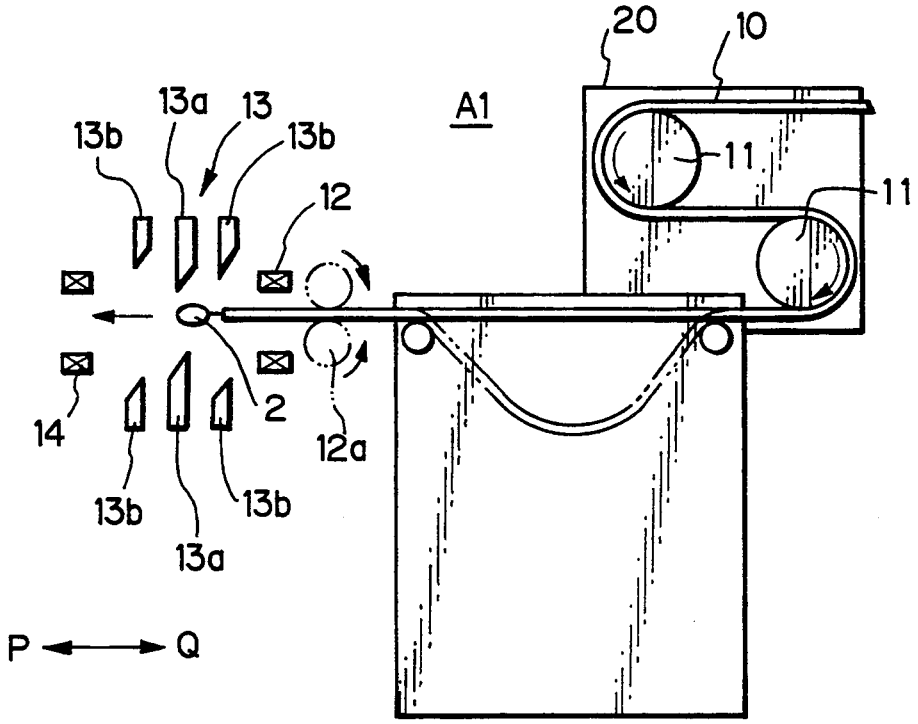
Fig. 15 PRIOR ART
FIG. 15 is a side view of the prior harness producing apparatus illustrating another state.
Figure 16:
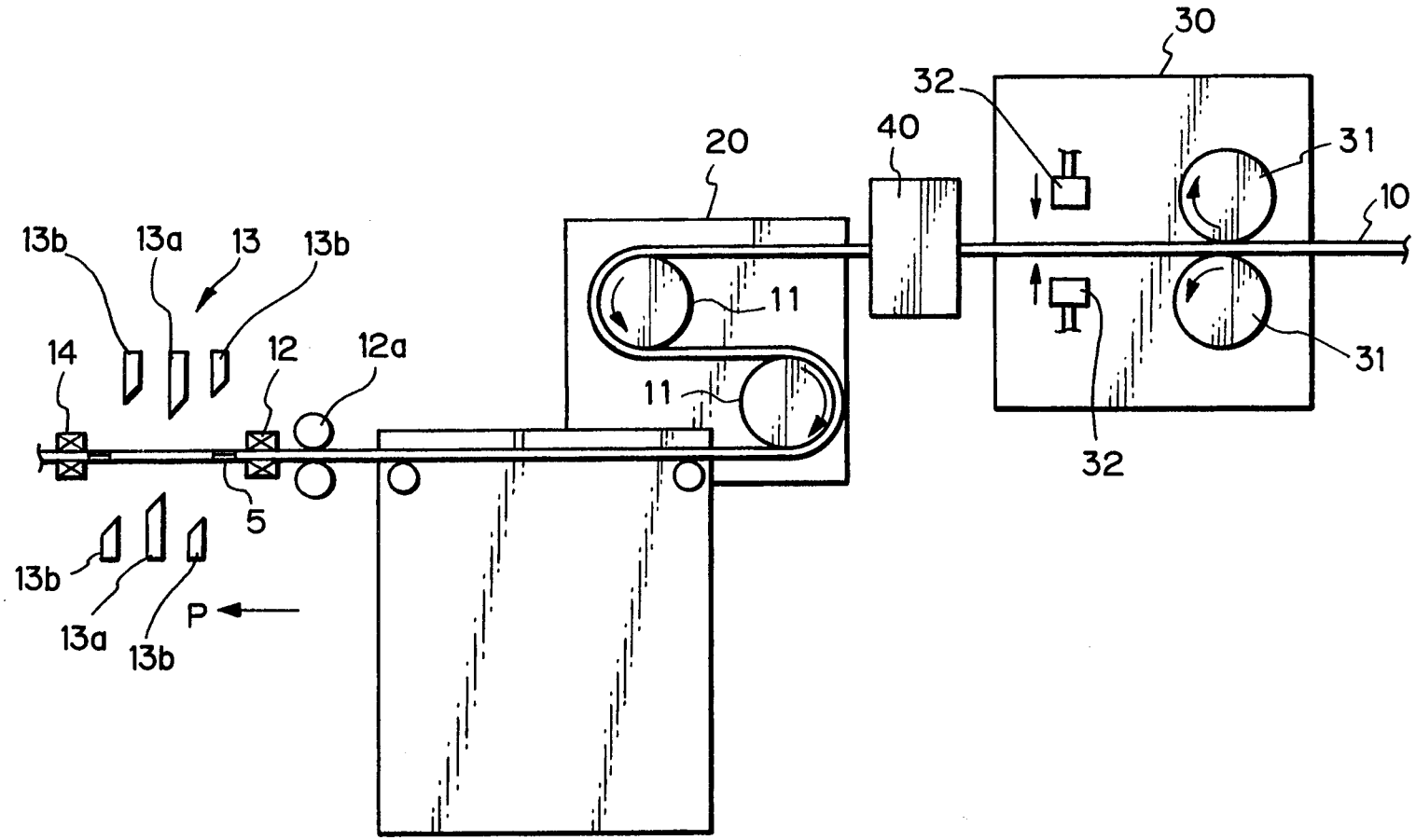
Fig. 16 PRIOR ART
FIG. 16 is a side view of the prior harness producing apparatus illustrating still another state.

Also, although tile right and left marking heads 221*a* and 221*b* are driven simultaneously by a single driving means in the marking mechanism 200 in the above embodiments, they may be individually driven by different driving means, as shown in FIG. 11. In this case,for example, only the right marking head 221*a* is driven so that it applies the mark 53 on the cable 50, thereby producing the harness 51 having the terminal 53 on one end and the stripped portion on the other end to be Jointed to another electrical cable, as shown in FIG. 12.

It should be noted that the present invention is not limited to the marking manner described in the above embodiments, in which the marking heads 221*a* and 221*b* made of a felt material which can hold the coloring agent contact with the outer surface of the cable 50 to provide the distinctive mark 53 on the cable. For example, a heat transcription system, an injection system or the like may be utilized.

According to the present invention, since the cable path length adjusting mechanism for adjusting the cable path length is provided between the marking mechanism and the cable end treating mechanism, it is possible to position the electrical cable with respect to the cable end treating unit and marking mechanism only by means of a feeding operation due to the cable feeding mechanism and by setting the cable path length to a given length in accordance with the cut cable by means of the cable path length adjusting mechanism. At this time, a relative distance between the cable cutting position and the distinctive mark applying position is not changed. It is possible to apply the distinctive mark at the proper position on the cable and thus is possible to precisely apply the distinctive mark at a given area on the harness. In addition, the marking mechanism is disposed not near the cable end treating unit in which many devices have a complicated arrangement but on an upper stream from the marking mechanism. Consequently, the marking mechanism does not bring about a complicated construction of the apparatus.

What is claimed is:

1. A harness producing apparatus comprising:

a cable feeding mechanism for intermittently feeding an electrical cable by a given length in its longitudinal direction;

a marking mechanism disposed on an upper stream along a cable feeding direction of said cable feeding mechanism for applying a distinctive mark on said electrical cable during a feed resting period of said cable feeding mechanism;

a cable end treating unit disposed on a lower stream in said cable feeding direction of said cable feeding mechanism for cutting said cable fed by the given length to form a cut electrical cable having a given length during said feed resting period of said cable feeding mechanism; and a cable path length adjusting mechanism for adjusting a cable path length between said marking mechanism and said cable end treating mechanism in accordance with the length of said cut cable.

2. A harness producing method by using a harness producing apparatus including:

a cable feeding mechanism for feeding an electrical cable in its longitudinal direction;

a marking mechanism disposed on an upper stream along a cable feeding direction of said cable feeding mechanism for applying a distinctive mark on said electrical cable;

a cable end treating unit disposed on a lower stream in said cable feeding direction of said cable feeding mechanism for cutting said cable fed; and a cable path length adjusting mechanism disposed between said marking mechanism and said cable end treating mechanism for adjustably setting a cable path length therebetween;

said method comprising the steps of:

setting said cable path length between said marking mechanism and said cable end treating unit to be a given length in accordance with the length of the cut cable by said cable path adjusting mechanism:

feeding said electrical cable intermittently by a given length by said cable feeding mechanism;

applying a distinctive mark on said electrical cable during a feed resting period by said marking mechanism; and cutting said electrical cable fed by a given length from said cable feeding mechanism to form a cut electrical cable having a given length by said cable end treating unit during said feed resting period.

* * * * *